US010036616B2

(12) United States Patent
Gash et al.

(10) Patent No.: US 10,036,616 B2
(45) Date of Patent: Jul. 31, 2018

(54) ARCHITECTED MATERIALS AND STRUCTURES TO CONTROL SHOCK OUTPUT CHARACTERISTICS

(71) Applicant: LAWRENCE LIVERMORE NATIONAL SECURITY, LLC, Livermore, CA (US)

(72) Inventors: Alexander E. Gash, Brentwood, CA (US); Eric B. Duoss, Dublin, CA (US); Joshua D. Kuntz, Livermore, CA (US); Kyle T. Sullivan, Pleasanton, CA (US); John Vericella, Oakland, CA (US); Bradley W. White, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 15/050,974

(22) Filed: Feb. 23, 2016

(65) Prior Publication Data

US 2017/0241754 A1 Aug. 24, 2017

(51) Int. Cl.
*F42B 1/02* (2006.01)
*F42B 1/036* (2006.01)

(52) U.S. Cl.
CPC ..... *F42B 1/02* (2013.01); *F42B 1/036* (2013.01)

(58) Field of Classification Search
CPC .... F42B 1/00; F42B 1/02; F42B 1/036; F42B 3/08; F42B 3/22; F42B 5/10; B33Y 10/00; B33Y 30/00; B33Y 70/00
USPC .... 102/305, 306, 307, 309, 475, 476; 86/56, 86/1.1
See application file for complete search history.

(56) References Cited

U.S. PATENT DOCUMENTS

| | | | | |
|---|---|---|---|---|
| 2,604,042 A | | 7/1952 | Cook | |
| 2,656,003 A | | 10/1953 | Poulter | |
| 4,729,318 A | | 3/1988 | Marsh | |
| 4,896,609 A | * | 1/1990 | Betts | F42B 1/02 102/307 |
| 5,187,319 A | * | 2/1993 | Nouguez | C06B 45/10 102/202.1 |
| 6,352,029 B1 | * | 3/2002 | Guirguis | C06B 45/00 102/286 |

(Continued)

FOREIGN PATENT DOCUMENTS

| | | | | |
|---|---|---|---|---|
| DE | 10251676 A1 | * | 5/2004 | F42B 1/02 |
| EP | 2279388 B1 | | 12/2015 | |

(Continued)

OTHER PUBLICATIONS

International Search Report and Written Opinion corresponding to U.S. Appl. No. 15/050,974, 14 pages.

(Continued)

*Primary Examiner* — James S Bergin
(74) *Attorney, Agent, or Firm* — Eddie E. Scott

(57) ABSTRACT

A system that provides control of the output shockwave properties of energetic material wherein the system includes an energetic material having a first portion and a second portion. An additive manufacturing system combines the first portion and the second portion of the energetic material wherein the first portion and the second portion are positioned relative to each other to provide control of the output shockwave properties of the energetic material.

16 Claims, 7 Drawing Sheets

(56) References Cited

U.S. PATENT DOCUMENTS

| | | | | |
|---|---|---|---|---|
| 8,813,651 | B1 | 8/2014 | Hooke | |
| 9,163,914 | B2 | 10/2015 | Carton | |
| 9,612,095 | B2 * | 4/2017 | Smart | F42B 1/032 |

FOREIGN PATENT DOCUMENTS

| | | | | | |
|---|---|---|---|---|---|
| GB | 637332 | A | * | 5/1950 | B21D 26/08 |
| GB | 789041 | A | * | 1/1958 | C06B 45/10 |
| WO | 86-07000 | A1 | | 12/1986 | |

OTHER PUBLICATIONS

Simpson et al., "Transforming Explosive Art into Science," S&TR, 1997, 17 pages.
Sullivan et al., "Directed Assembly of Energetic Materials with Micro-Engineered Architectures," LLNL Poster-516073, 2011, 1 page.
Sullivan et al., "Thermite Research Heats Up," S&TR, 2015, 4 pages.

* cited by examiner

ARCHITECTED MATERIALS AND STRUCTURES TO CONTROL SHOCK OUTPUT CHARACTERISTICS

STATEMENT AS TO RIGHTS TO APPLICATIONS MADE UNDER FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present application relates to additive manufacturing, and more particularly to architected materials and structures to control shock output characteristics.

State of Technology

This section provides background information related to the present disclosure which is not necessarily prior art.

Current methods of shock initiation and control of the wavefront properties are limited by the manufacturing methods and materials available for specific types of processing (machining, pressing, extruding, etc.), however the desire for control over the output shock front of an energetic material and/or high explosive is for materials or devices that perform outside of capabilities currently available.

The output detonation front of a dense explosive material is affected by the edges of the geometry of the explosive part such that, during detonation through the material, the pressure front lags the bulk shock front of the material. This results in a parabolic or curved shock front through the cross section of the part. Many applications are not affected by the this difference in the arrival time of the shock front as a function of time, but some, including study of the fundamental behavior of energetic and non-energetic materials, are very much affected by this difference, and as such, alternative methods other than bulk explosive materials must be used, such as a plane wave generator, or a gas gun or propelled material to initiate the detonation or shock the material. Current plane wave generators are created using two different high explosives, machined into a geometry of a nested cone within a cylinder, and are then mated together. This requires very precise machining, as any gaps between the materials will result in a malformed shock front, and a very limited set of materials which may be used. On top of these technical hurdles, the output wave, which arrives in a linear fashion, does not have a uniform pressure profile. Gas gun techniques, while very effective and well understood, require specialized facilities, are normally only able to perform one experiment at a time, and are labor intensive. Both of these types of uniform initiation systems are not able to quickly, accurately, and arbitrarily deliver a shock front in a cost and time effective manner.

There have been ways to produce plane wave generators using HE materials, but they have:

a.) Only been made as a cylindrical, plane wave generator b.) Have only been made with pressing, machining and joining c.) Have only been made using a handful of HE materials These efforts have been very expensive ($50 k/each). They are rarely used due to their expense.

Previous methods of modifying the output characteristics of an energetic/HE bulk part could only achieve specific changes to the shock characteristics, such as the shock front arrival time as a function of radial distance. These parts are extremely difficult to machine and assemble, and resulted in a prohibitively expensive HE part that only has one type/shape of output. The other disadvantage of these systems is that only specific types of energetic materials fit all of the criteria needed to enable both the effects desired (difference in detonation speed, energy density, etc.) and the correct processing constraints (machining, pressing, etc.). With the inventors' additive manufacturing apparatus, systems, and methods, the available types of materials that can be used to manufacture an energetic part as well as the types of HE printed, giving complete control over the propagation and arrival behavior of the part after detonation.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

The inventors' apparatus, systems, and methods include designing, fabricating, and using systems that arbitrarily control the output shockwave properties of an energetic material, including but not limited to, shock pressure, wave front shape, and arrival time, by way of additive manufacturing. The inventors' apparatus, systems, and methods of propagation through a printed structure is also able to create a planar wave front with uniform pressure across a 2D surface, thus functioning as a plane wave generator (PWG). Using multiple directions of design freedom, such as arbitrary composition control, path length, spacing, structure architecture, or combinations thereof, the energetic output can be designed and physically built into an additively manufactured structure with arbitrary geometry. In this patent application the inventors outline the concept of the system on a fundamental level, illustrate possible implementation methods, and then provide data from structures created using the inventors' apparatus, systems, and methods.

With additive manufacturing methods, the available types of materials that can be used to manufacture an energetic part as well as the types of HE printed, giving complete control over the propagation and arrival behavior of the part after detonation. The inventors' additive manufacturing apparatus, systems, and methods allow the direct fabrication of the structure that controls the shock propagation and delivery as opposed to the complicated assembly of many different parts, structures, materials and processes in order to modify the shock behavior.

The inventors' apparatus, systems, and methods have many uses. For example, the inventors' apparatus, systems, and methods have use as a plane wave generator. The inventors' apparatus, systems, and methods can be used by contractors in Oil and Gas, Mining, Aerospace, Defense.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

FIG. 1F illustrates an embodiment of a plane wave generator produced by the inventors' apparatus, systems, and methods.

FIG. 1G illustrates another embodiment of a plane wave generator produced by the inventors' apparatus, systems, and methods.

DETAILED DESCRIPTION OF SPECIFIC EMBODIMENTS

Figures 1A, 1B, 1C:
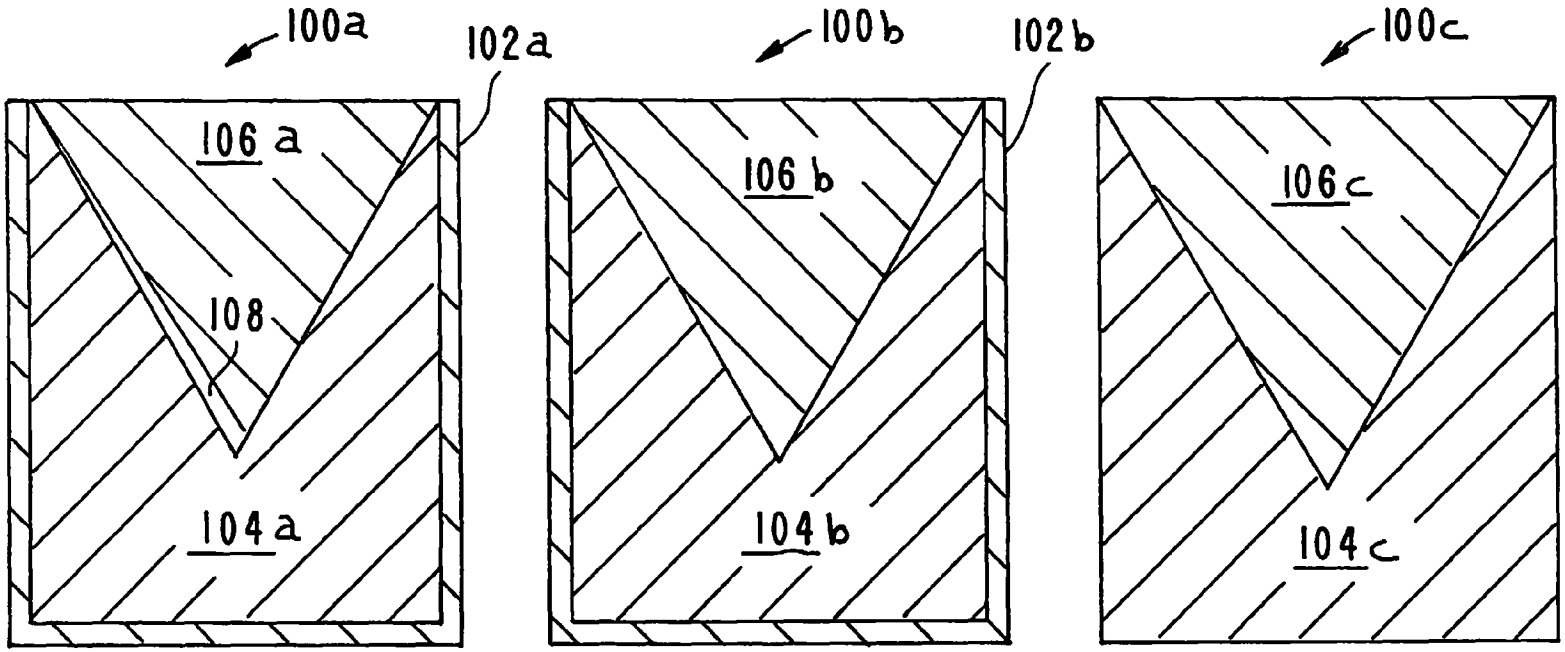
FIG. 1A illustrates a prior art cylindrical, plane wave generator.
FIG. 1B illustrates one embodiment of a cylindrical, plane wave generator produced by the inventors' apparatus, systems, and methods.
FIG. 1C illustrates another embodiment of a cylindrical, plane wave generator produced by the inventors' apparatus, systems, and methods.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

The inventors' apparatus, systems, and methods include designing, fabricating and using systems that arbitrarily control the output shockwave properties of an energetic material, including but not limited to, shock pressure, wavefront shape, and arrival time, by way of additive manufacturing. The printed parts may take many different forms. The inventors may print the HE material directly in a 3D architecture and the inventors may create substrates or molds. Also, there may be a combination of the two methods in order to create the desired energetic structure. In various embodiments the inventors' apparatus, systems, and methods provide structure and combination of energetic materials, or gradients/arbitrary placement of these materials, that will modify the shock output characteristics of the energetic material(s). A planar wave output may be desired, where planar means that there is specific spontaneity value of shockwave arrival time across a specific area of the output plane. This may, however, be completely tailored for a given application, using the same fabrication techniques.

The inventors disclose specific methods of additive manufacturing in relation to HE materials; however it is to be understood that there are additional methods. The inventors disclose methods are identified and described below.

1. Direct Ink Write—where a paste formulation of HE is deposited using a robotic stage
2. Powderbed Printing—a powderbed of HE or energetic material is bound together
3. Fused Deposition Modeling—an off the shelf 3D printer that can print complex molds While the method of implementation can be modified in many different ways, the basic idea/premise is that the inventors are modifying the 4D (3D+time) behavior of a shock wave propagating through a printed material, be it HE or other, in order to arbitrarily control the shock output behavior.

Manufacture of a device, which is able to control the wavefront properties of arrival time, pressure, and intensity using additive manufacturing has not yet been employed. Using this method the inventors are able to create arbitrary, tortuous, geometries that are not possible to produce in any other way, or are exceedingly complicated, time intensive and costly to produce using traditional or subtractive manufacturing techniques.

In the prior art the output detonation front of a dense explosive material is affected by the edges of the geometry of the explosive part such that, during detonation through the material, the pressure front lags the bulk shock front of the material. This results in a parabolic or curved shock front through the cross section of the part.

Current plane wave generators are created using two different high explosives, machined into a geometry of a nested cone within a cylinder, and are then mated together. This requires very precise machining, as any gaps between the materials will result in a malformed shock front, and a very limited set of materials which may be used. On top of these technical hurdles, the output wave, which arrives in a linear fashion, does not have a uniform pressure profile. Gas gun techniques, while very effective and well understood, require specialized facilities, are normally only able to perform one experiment at a time, and are labor intensive. Both of these types of uniform initiation systems are not able to quickly, accurately, and arbitrarily deliver a shock front in a cost and time effective manner.

There have been ways to produce plane wave generators using HE materials, but they have:

a.) Only been made as a cylindrical, plane wave generator.

b.) Have only been made with pressing, machining and joining.

c.) Have only been made using a handful of HE materials.

These efforts have been very expensive ($50 k/each). They are rarely used due to their expense.

Previous methods of modifying the output characteristics of an energetic/HE bulk part could only achieve specific changes to the shock characteristics, such as the shock front arrival time as a function of radial distance. These parts are extremely difficult to machine and assemble, and resulted in a prohibitively expensive HE part that only has one type/shape of output. The other disadvantage of these systems is that only specific types of energetic materials fit all of the criteria needed to enable both the effects desired (difference in detonation speed, energy density, etc.) and the correct processing constraints (machining, pressing, etc.).

U.S. Pat. No. 2,604,042 issued Jul. 30, 1948 provides information about prior art cylindrical, plane wave generators. Representative information from the patent is reproduced below. The disclosure of U.S. Pat. No. 2,604,042 issued Jul. 30, 1948 is incorporated herein in its entirety for all purposes by this reference.

When a comparatively short cylinder or other plane ended columnar body of detonating explosive having an axis perpendicular to its ends and the same cross section throughout its axial length has its detonation initiated from a point at one end of its axis, the detonation wave front advancing through the column is convex.

U.S. Pat. No. 4,729,318 issued Mar. 8, 1988 provides information about prior art cylindrical, plane wave generators. Representative information from the patent is reproduced below. The disclosure of U.S. Pat. No. 4,729,318 issued Mar. 8, 1988 is incorporated herein in its entirety for all purposes by this reference.

In the field of high explosives it is often necessary to shape the detonation shock wave to a prescribed pat-tern. If a point source is used to detonate a right cylinder of explosive material, the shock wave will propagate through the cylinder in a spherical pattern. The exiting shock wave will be spherical as well. If the desired shape of the shock wave is planar, then a lens must be used to reshape the wave.

One of the most common ways to convert a point source shock wave into a plane wave is by tailoring the shape of the explosive material. A typical explosive plane-wave lens includes a first cone made of a low velocity detonation material such as baratol (a mixture of barium nitrate and TNT). The flat portion of the cone is positioned against the device for which the user intends to transmit a planar wave. A second detonation material having a high detonation velocity is cast over the baratol and machined so the outside contour is cone shaped. In operation a detonator is used to initiate the high detonation velocity explosive at the apex of the cone. By the time the wave has reached the flat end of the cone, the shock wave is planar. This method is described in U.S. Pat. No. 2,604,042.

Referring now to FIG. 1A, a prior art cylindrical, plane wave generator is illustrated. The prior art cylindrical, plane wave generator is designated generally by the reference numeral 100*a*.

The prior art cylindrical, plane wave generator 100*a* is created using two different high explosives 104*a* and 106*a* in a container 102*a*. The two different high explosives 104*a* and 106*a* are machined into a geometry of a nested cone within a cylinder and are then mated together. This requires very precise machining, alignment, and positioning of the two parts. A very limited set of materials can be used. As illustrated in FIG. 1A gaps such as gap 108 in the assembled parts will result in a malformed shock front.

The prior art parts 104*a* and 106*a* are extremely difficult to machine and assemble, and resulted in a prohibitively expensive HE part that only has one type/shape of output. Other disadvantage of the he prior art systems is that only specific types of energetic materials fit all of the criteria needed to enable both the effects desired (difference in detonation speed, energy density, etc.) and the correct processing constraints (machining, pressing, etc.).

Referring now to FIG. 1B, one embodiment of the inventors' cylindrical, plane wave generator is illustrated. This embodiment of the inventors' cylindrical, plane wave generator is designated generally by the reference numeral 100*b*. The embodiment 100*b* of the inventors' cylindrical, plane wave generator is created using two different high explosives 104*b* and 106*b* in a container 102*b*. The two different high explosives 104*a* and 106*a* in a container 102*b* are produce by additive manufacturing. There are no voids left between the two different high explosives 104*b* and 106*b*.

The printed high explosives 104*b*, high explosives 106*b*, and container 102*b* may take many different forms. The inventors may print the HE material directly in a 3D architecture, the inventors may create substrates or molds, and there may be a combination of the two methods in order to create the desired energetic structure. The inventors' idea is that the structure and combination of energetic materials, or gradients/arbitrary placement of these materials, will modify the shock output characteristics of the energetic material(s). A planar wave output may be desired, where planar means that there is specific spontaneity value of shockwave arrival time across a specific area of the output plane. This may, however, be completely tailored for a given application, using the same fabrication techniques.

The inventors describe three methods of additive manufacturing in relation to HE materials below; however, it is to be understood that there are other methods.

Direct Ink Write—where a paste formulation of HE is deposited using a robotic stage Powderbed Printing—a powderbed of HE or energetic material is bound together Fused Deposition Modeling—an off the shelf 3D printer that can print complex molds The inventors' method of implementation can be modified in many different ways, the basic idea/premise is that the inventors are modifying the 4D (3D+time) behavior of a shock wave propagating through a printed material, be it HE or other, in order to arbitrarily control the shock output behavior.

Referring now to FIG. 1C, another embodiment of the inventors' cylindrical, plane wave generator is illustrated. This embodiment of the inventors' cylindrical, plane wave generator is designated generally by the reference numeral 100*c*. The embodiment 100*c* of the inventors' cylindrical, plane wave generator is created using two different high explosives 104*c* and 106*c*. The embodiment 100*c* does not include a container. The container 106 illustrated in FIG. 1B is useful for handling; however, additive manufacturing easily enables the creation of cylindrical, plane wave generator is created using two different high explosives 104*c* and 106*c* without a container.

The two different high explosives 104*a* and 106*a* are produce by additive manufacturing. There are no voids left between the two different high explosives 104*c* and 106*c*.

The printed high explosives 104*c* and high explosives 106*c* may take many different forms. The inventors may print the HE material directly in a 3D architecture, the inventors may create substrates or molds, and there may be a combination of the two methods in order to create the desired energetic structure. The inventors' idea is that the structure and combination of energetic materials, or gradients/arbitrary placement of these materials, will modify the shock output characteristics of the energetic material(s). A planar wave output may be desired, where planar means that there is specific spontaneity value of shockwave arrival time across a specific area of the output plane. This may, however, be completely tailored for a given application, using the same fabrication techniques.

The inventors describe three methods of additive manufacturing in relation to HE materials below; however, it is to be understood that there are other methods.

Direct Ink Write—where a paste formulation of HE is deposited using a robotic stage Powderbed Printing—a powderbed of HE or energetic material is bound together Fused Deposition Modeling—an off the shelf 3D printer that can print complex molds The inventors' method of implementation can be modified in many different ways, the basic idea/premise is that the inventors are modifying the 4D (3D+time) behavior of a shock wave propagating through a printed material, be it HE or other, in order to arbitrarily control the shock output behavior.

Figure 1E:
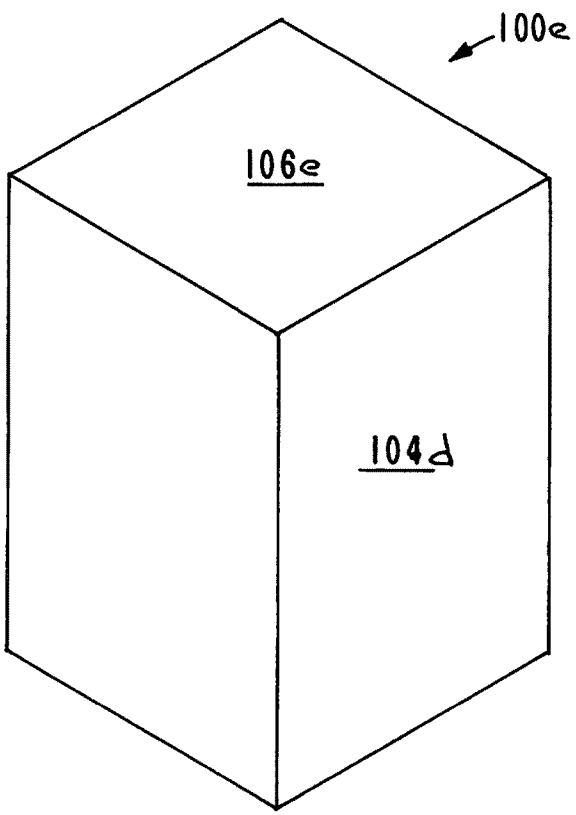
FIGS. 1D and 1E illustrate an embodiment of a plane wave generator in the form of a cube or an elongated cube produced by the inventors' apparatus, systems, and methods.
Figure 1D:
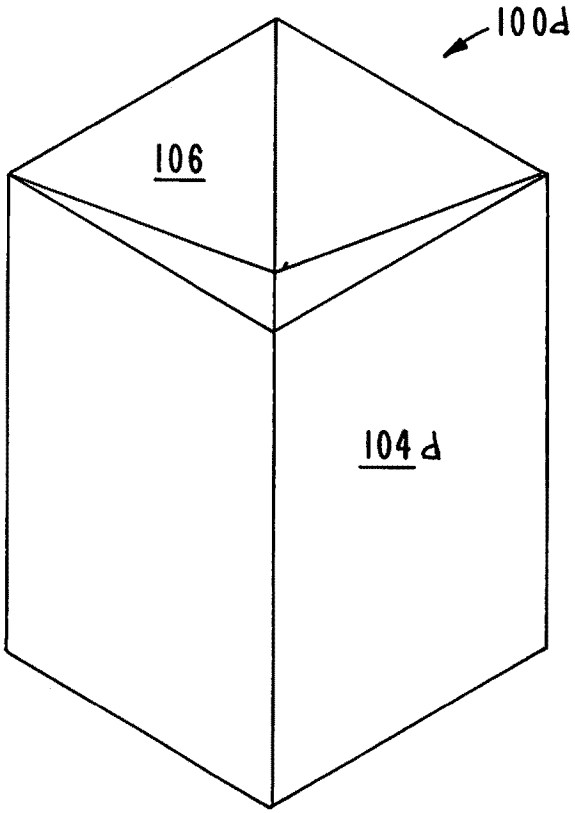
Figures 1A, 1B, 1C:
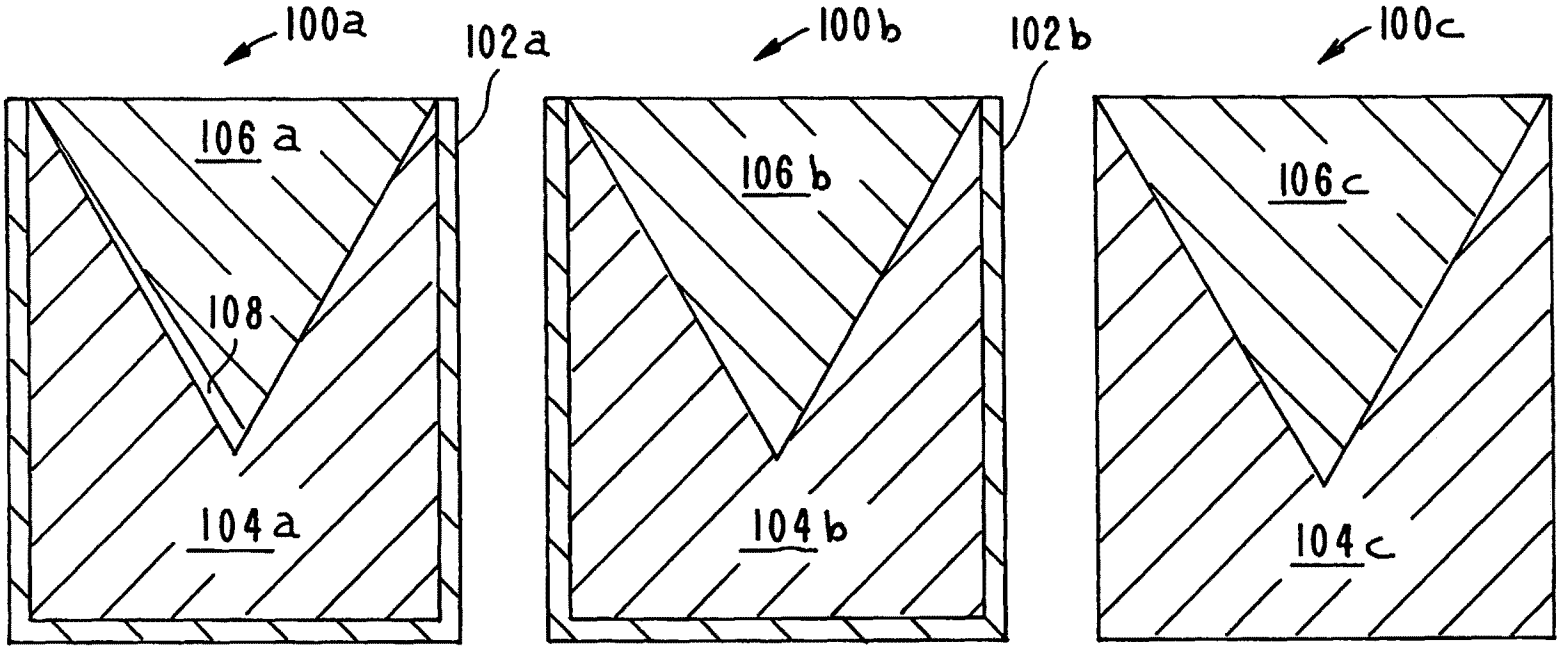

Referring now to FIGS. 1D and 1E, an embodiment of a plane wave generator in the form of a cube or an elongated cube produced by the inventors' apparatus, systems, and methods is illustrated. This embodiment of the inventors' cubical or elongated cubical, plane wave generator is designated generally by the reference numeral 100*d*. The embodiment 100*d* is created using two different explosive materials 104*d* and 106*e*. The cubical, plane wave generator 100*d* and the two different explosive materials 104*d* and 106*e* are produce by additive manufacturing. There are no voids left between the two different two different explosive materials 104*d* and 106*e*.

Referring now to FIG. 1D, additive manufacturing is used to create the cubical, plane wave generator 100*d*. FIG. 1D shows the first explosive material 104*a* with hollow portion 106. Referring to FIG. 1E, the hollow portion 106 is shown having been filled with the second explosive material 106*e*. The second explosive material 106*e* has a slow detonation velocity; whereas first explosive material 104*a* has a faster detonation velocity. The fast detonation velocity of the first explosive material 104*a* expands on a spherical front, driving a flat wave in the second explosive material 106*e* that is moving at its detonation velocity. The two explosives are chosen such that the detonation velocity of the fast explosive is related to that of the slow explosive in a manner to produce a flat wave.

Referring now to FIG. 1F, another embodiment of the inventors' plane wave generator is illustrated. This embodiment of the inventors' cylindrical, plane wave generator is designated generally by the reference numeral 100*f*. The inventors' plane wave generator 100*f* can be of a cylindrical shape, a cubical shape, an elongated cubical shape, or other shapes.

The embodiment 100*f* of the inventors' plane wave generator is created using additive manufacturing of the same high explosive; however the first portion 104*f* has a first density and the second portion 106*f* has a second density that is less dense that the first portion 104*f*. There are no voids left between the first portion 104*f* and the second portion 106*f*. The first portion 104*f* has a fast detonation velocity that expands on a spherical front, driving a flat wave in the second portion 106*f* with a density that is less dense that the first portion 104*f*. The two portions are chosen with densities such that the detonation velocity of the fast explosive is related to that of the slow explosive in a manner to produce a flat wave.

Referring now to FIG. 1G, yet another embodiment of the inventors' plane wave generator is illustrated. This embodiment of the inventors' cylindrical, plane wave generator is designated generally by the reference numeral 100*g*. The inventors' plane wave generator 100*g* can be of a cylindrical shape, a cubical shape, an elongated cubical shape, or other shapes.

The embodiment 100*g* of the inventors' plane wave generator is created using additive manufacturing of the same high explosive; however there is a gradient 112 from an area of maximum density 110 to and area of minimum density 114. The area of maximum density 110 has a fast detonation velocity that expands on a spherical front, driving a flat wave toward the area of minimum density 114. The gradient 112 is chosen that the detonation velocity of the area of maximum density 110 is related to the area of minimum density 114 in a manner to produce a flat wave.

Figure 2:
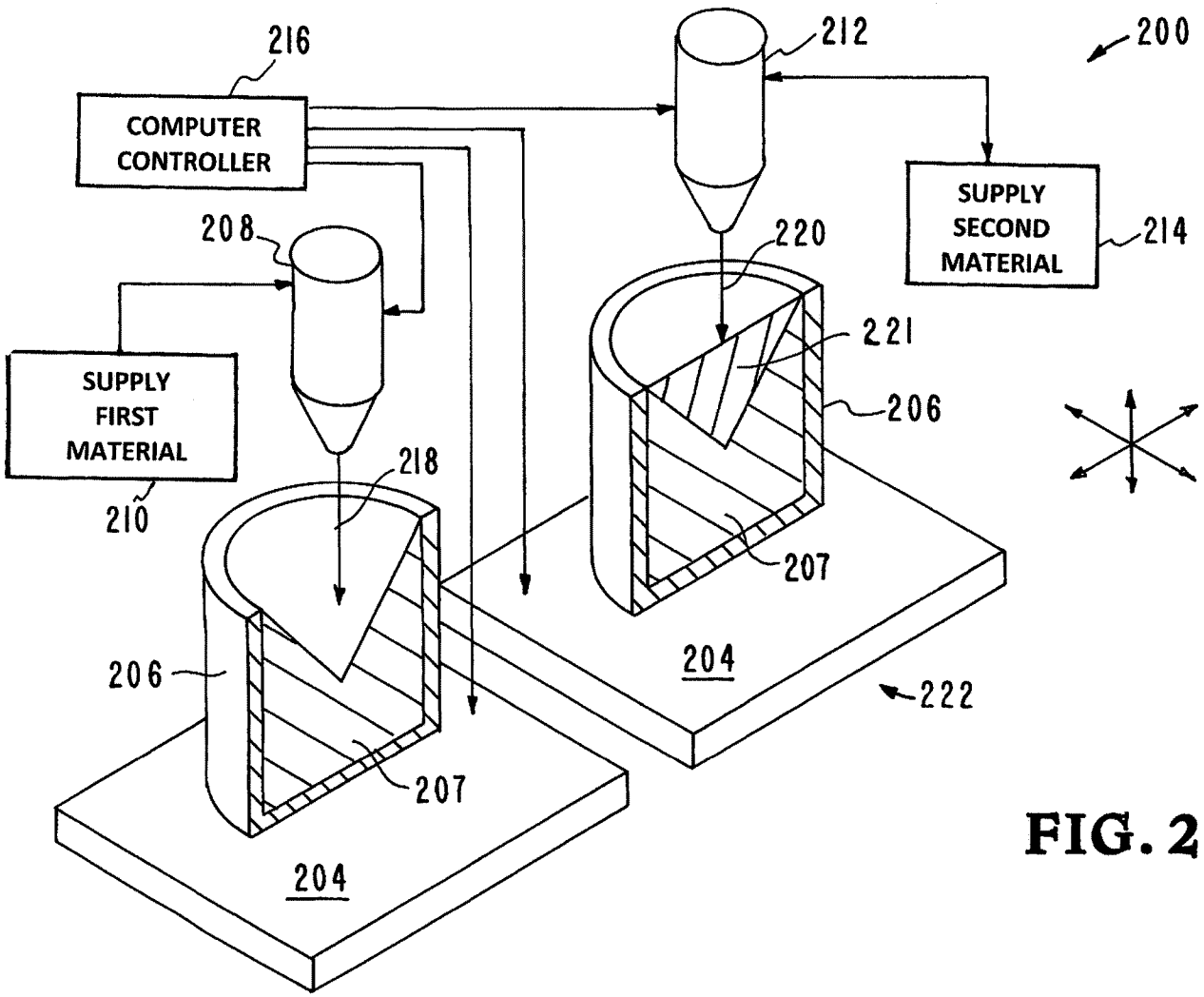
FIG. 2 illustrates an embodiment of the inventors' apparatus, systems, and methods for controlling the output shockwave properties of an energetic material, including but not limited to, shock pressure, wave front shape, and arrival time, by way of additive manufacturing.

Referring now to FIG. 2, an embodiment of the inventors' apparatus, systems, and methods of additively manufacturing a cylindrical, plane wave generator are illustrated. This embodiment is designated generally by the reference numeral 200. The embodiment 200 uses additive manufacturing to create two different high explosives 207 and 221 in a container 206. The embodiment 200 includes the components and functions listed and described below.

First position 202.
Build platform 204.
Container 206.
First explosives material 207.
First print head 208.
Supply of a first explosives material 210.
Second print head 212.
Supply of a second explosives material 214.
Computer controller 216.
Material stream 218.
Material stream 220.
Second explosives material 221.
Second position 222.

The two different high explosives 207 and 221 in a container 206 are produce by additive manufacturing.

The structural components of the embodiment 200 of the inventors' apparatus, systems, and methods of additively manufacturing a cylindrical, plane wave generator having been identified and described, the operation of the embodiment 200 of the inventors' apparatus, systems, and methods of additively manufacturing a cylindrical, plane wave generator will now be considered.

A plane wave generator (PWG) is an arrangement of low and high velocity explosives in a plane-wave lens. Most operate by transforming the spherical wave from a single detonator to a plane wave using a central cone of explosive with a slow detonation velocity, bounded by an outer sheath with a faster detonation velocity. The fast detonation velocity of the outer explosive expands on a spherical front, driving a flat wave in the central explosive that is moving at its detonation velocity. The two explosives are chosen such that the detonation velocity of the fast explosive is related to that of the slow explosive in a manner to produce a flat wave.

Current flat wave explosive lenses, although successful, have problems; they tend to be expensive, require rigid tolerances and often prohibitive machining costs result in great expense in their production and use. Further, complex explosive formulations often make the uniform fabrication of lenses difficult. Also, the pressure states particular at large diameter may be different even if the shock arrival is simultaneous.

In one version of the embodiment 200 of the inventors' apparatus, systems, and methods of additively manufacturing a cylindrical, plane wave generator, the container 206 is constructed by conventional means and positioned on the build platform 204. The various layers of the first explosive 207 are deposited in the container by the print head 208. The various layers of the second explosive 221 are deposited on the first explosive 207 in the container by the print head 212 to complete the embodiment 200 of the inventors' apparatus, systems, and methods of additively manufacturing a cylindrical, plane wave generator.

In another version of the embodiment 200, the first explosive 207, the second explosive 221, and the container 206 are produced by additive manufacturing. A first layer of the first explosive 207 and the container 206 is deposited on the build platform 204 by the print head 208. The print head 208 has a nozzle for extruding the stream of material 218 onto the build platform 204. The supply of first material 210 provides the stream of material 218. Movement of the print head 208 creates the first layer of structural elements of the first explosive 207 and the container 206 on the build platform 204.

Movement of the print head 208 is controlled by computer controller 216 which provides freedom of movement along all axes. Information about the first explosive 207 and the container 206 to be created by the system 200 is fed to the computer controller 216 with numerical control programming. The computer controller 216 uses the instructions to move the print head 208 through a series of movements along the build platform 204 creating structural elements and forming the first layer of the first explosive 207 and the container 206 to be created. Once the first layer is produced a second layer is created on top the first layer by the print head 212 extruding the material for the second layer onto the first layer with movement of the print head 212 controlled by the computer controller 216. The steps are repeated to produce successive additional layers until the final first explosive 207 and the container 206 are created.

Once the first explosive 207 and the container 206 are completed the second explosive 221 is added onto the first explosive 207 in the container 206 by additive manufacturing. The second explosive 221 is deposited on the first explosive 207 by the second print head 212. The second print head 212 has a nozzle for extruding the stream of the second explosive material 221 onto the on the first explosive 207. The supply of second material 214 provides the stream of material 220. Movement of the print head 212 creates the second explosive 221. There are no voids left by the additive manufacturing system 200.

The embodiment 200 of the inventors' apparatus, systems, and methods of additively manufacturing a cylindrical, plane wave generator produces the inventors' cylindrical, plane wave generator 100*b* illustrated in FIG. 1B. The inventors' cylindrical, plane wave generator 100*b* includes two different high explosives, first explosive 206 and second explosive 221. The second explosive 221 includes a central cone of explosive with a slow detonation velocity. The central cone of the second explosive 221 is bounded by an outer sheath of the first explosive 206 and the outer sheath of the first explosive 206 has a faster detonation velocity than the central cone of the second explosive 221. The fast detonation velocity of the outer explosive expands on a spherical front, driving a flat wave in the central explosive that is moving at its detonation velocity. The two explosives are chosen such that the detonation velocity of the fast explosive is related to that of the slow explosive in a manner to produce a flat wave.

Figure 3:
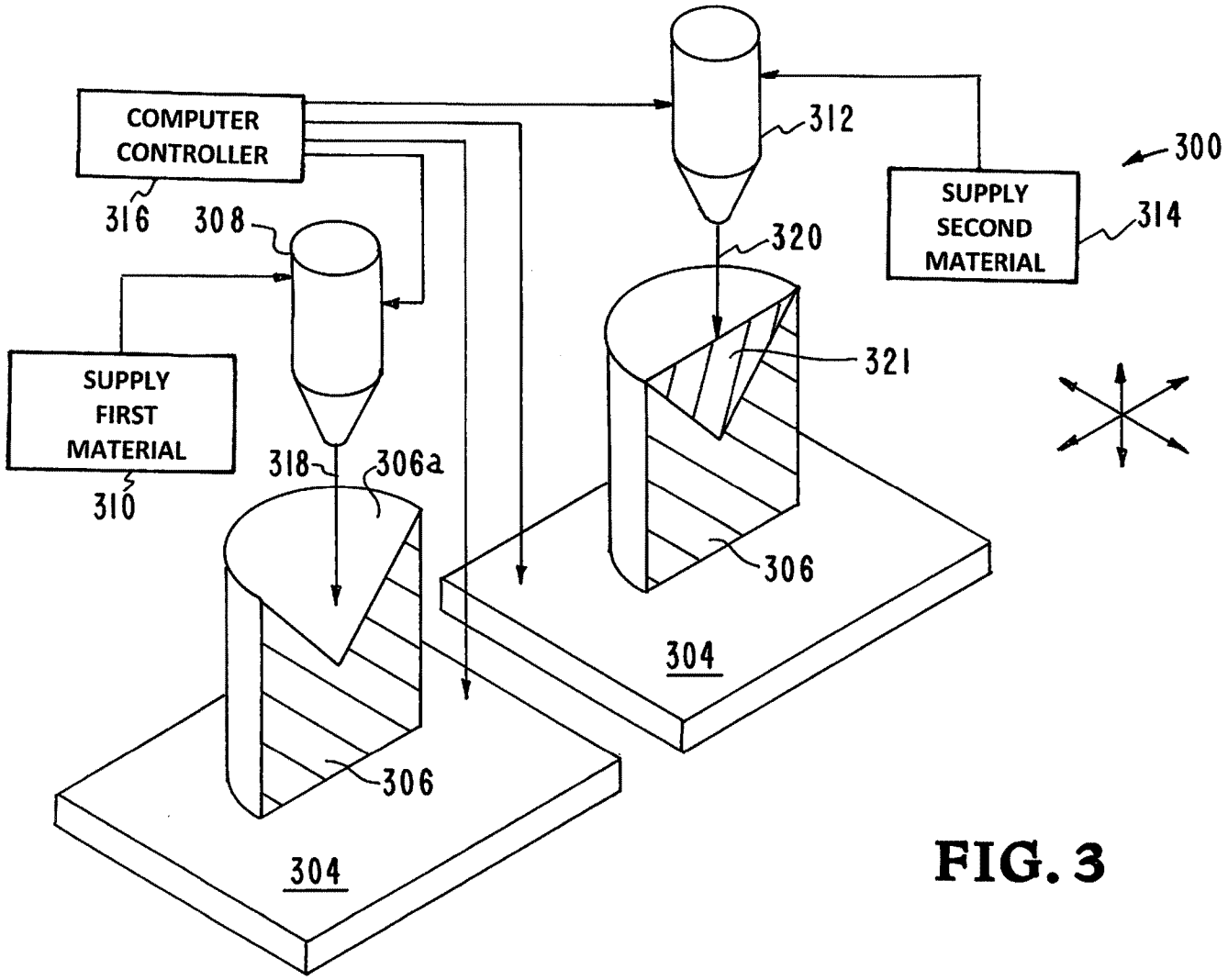
FIG. 3 illustrates another embodiment of the inventors' apparatus, systems, and methods for controlling the output shockwave properties of an energetic material, including but not limited to, shock pressure, wave front shape, and arrival time, by way of additive manufacturing.

Referring now to FIG. 3, another embodiment of the inventors' apparatus, systems, and methods of additively manufacturing a cylindrical, plane wave generator is illustrated. This embodiment is designated generally by the reference numeral 300. The embodiment 300 uses additive manufacturing to create two different high explosives, first explosive 306 and second explosive 321.

A first layer of the first explosive 306 is deposited on the build platform 304 by the print head 308. The print head 308 has a nozzle for extruding the stream of material 318 onto the build platform 304. The supply of first material 310 provides the stream of material 318. Movement of the print head 308 creates the first layer of structural elements of the first explosive 306 on the build platform 304.

Movement of the print head 308 is controlled by computer controller 316 which provides freedom of movement along all axes. Information about the first explosive 306 to be created by the system 300 is fed to the computer controller 316 with numerical control programming. The computer controller 316 uses the instructions to move the print head 308 through a series of movements along the build platform 304 creating structural elements and forming the first layer of the first explosive 306. The first explosive 306 has an internal surface 306*a* that forms an internal cone. Once the first layer is produced a second layer is created on top the first layer by the print head 312 extruding the material for the second layer onto the first layer with movement of the print head 312 controlled by the computer controller 316. The steps are repeated to produce successive additional layers until the final first explosive 306 is created.

Once the first explosive 306 is completed the second explosive 321 is added onto the first explosive 306 by additive manufacturing. The second explosive 321 is deposited on the first explosive 306 by the second print head 312. The second print head 312 has a nozzle for extruding the stream of the second explosive material 321 onto the on the first explosive 306. The supply of second material 314 provides the stream of material 320. Movement of the print head 312 creates the second explosive 321. The second explosive 321 is built upon the external cone shaped surface 306*a* of the first explosive 306. There are no voids left in the completed explosive by the additive manufacturing system 300.

The embodiment 300 of the inventors' apparatus, systems, and methods of additively manufacturing a cylindrical, plane wave generator produces the inventors' cylindrical, plane wave generator 100*c* illustrated in FIG. 1C. The embodiment 300 uses additive manufacturing to create two different high explosives, first explosive 306 and second explosive 321. The second explosive 321 includes a central cone of explosive with a slow detonation velocity. The central cone of the second explosive 321 is bounded by an outer sheath of the first explosive 306 and the outer sheath of the first explosive 306 has a faster detonation velocity than the central cone of the second explosive 321. The fast detonation velocity of the outer explosive expands on a spherical front, driving a flat wave in the central explosive that is moving at its detonation velocity. The two explosives are chosen such that the detonation velocity of the fast explosive is related to that of the slow explosive in a manner to produce a flat wave.

Figure 4A:
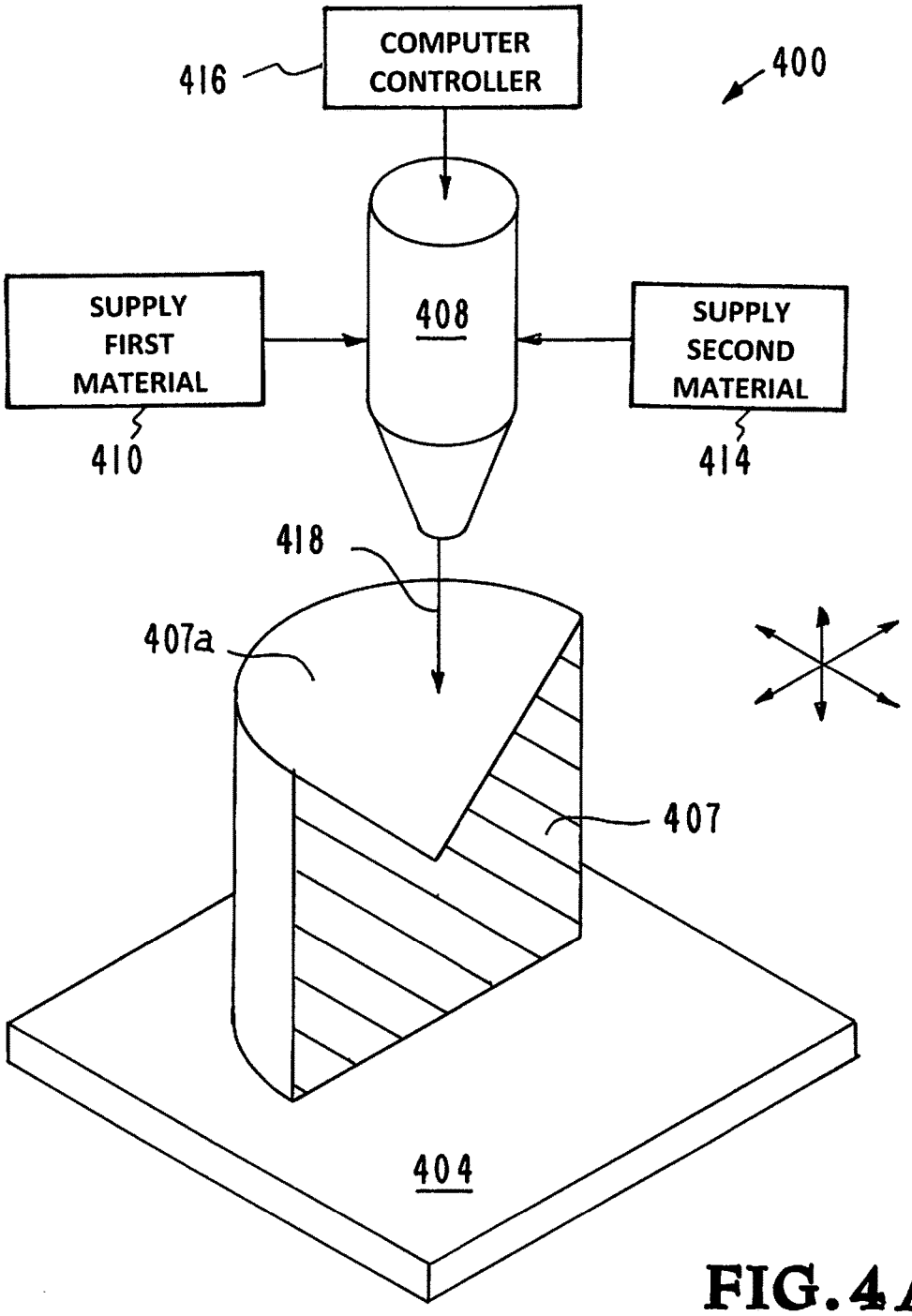
FIGS. 4A and 4B illustrate yet another embodiment of the inventors' apparatus, systems, and methods for controlling the output shockwave properties of an energetic material, including but not limited to, shock pressure, wave front shape, and arrival time, by way of additive manufacturing.
Figure 4B:
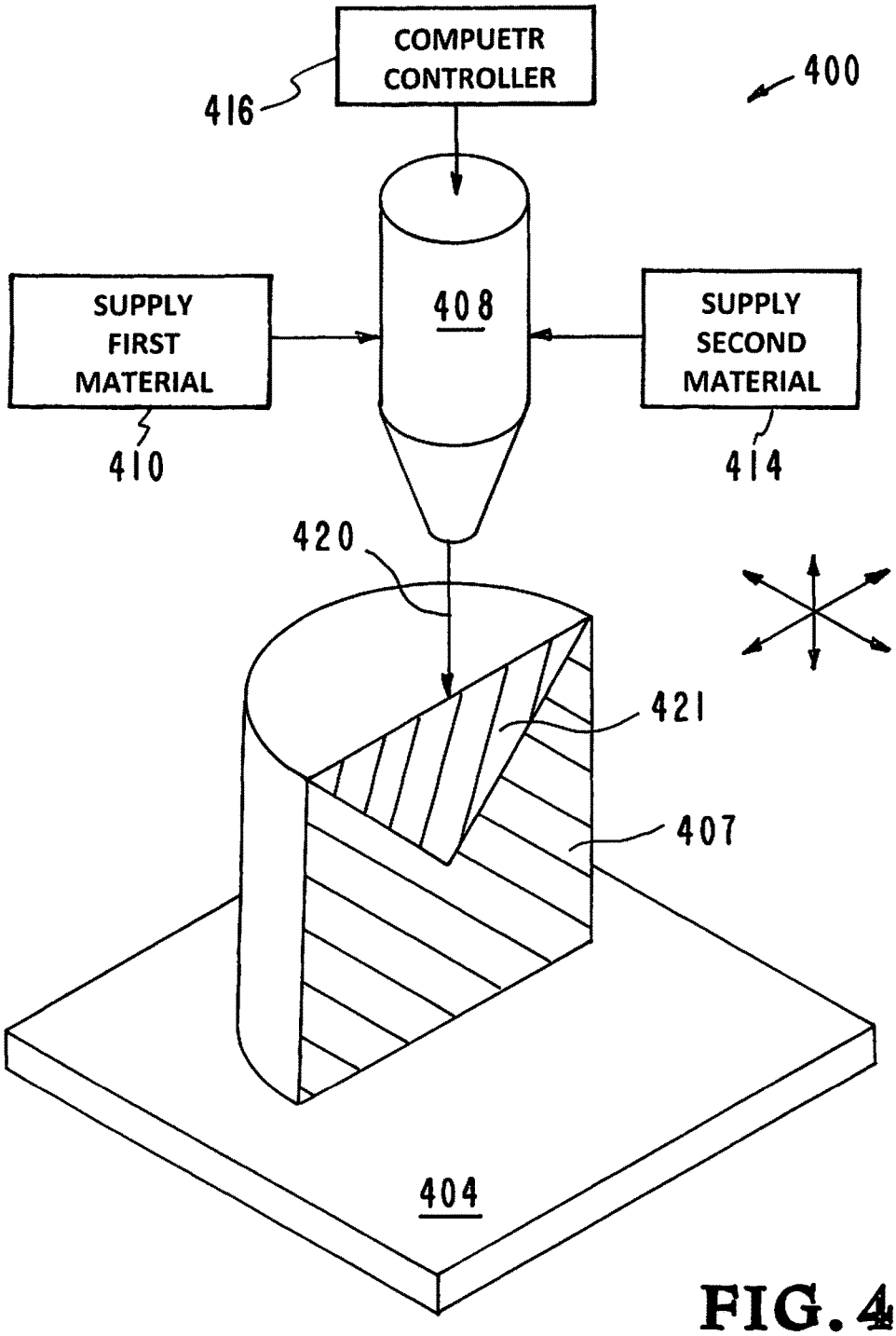

Referring now to FIGS. 4A and 4B, another embodiment of the inventors' apparatus, systems, and methods of additively manufacturing a cylindrical, plane wave generator is illustrated. This embodiment is designated generally by the reference numeral 400. The embodiment 400 uses additive manufacturing to create two different high explosives, first explosive 407 and second explosive 421.

As illustrated in FIG. 4A, the first layer of the first explosive 407 is deposited on the build platform 404 by the print head 408. The print head 408 has a nozzle for extruding the stream of material 418 onto the build platform 404. The supply of first material 410 provides the stream of material 418 to the print head 408. Movement of the print head 408 creates the first layer of structural elements of the first explosive 407 on the build platform 404.

Movement of the print head 408 is controlled by computer controller 416 which provides freedom of movement along all axes. Information about the first explosive 407 to be created by the system 400 is fed to the computer controller 416 with numerical control programming. The computer controller 416 uses the instructions to move the print head 408 through a series of moments along the build platform 404 creating structural elements and forming the first layer of the first explosive 407. Once the first layer is produced a second layer is created on top the first layer by the print head 408 extruding the material for the second layer onto the first layer with movement of the print head 408 controlled by the computer controller 416. The steps are repeated to produce successive additional layers until the final first explosive 407 is created. The first explosive has a surface cone shape 407*a*.

Once the first explosive 407 is completed the second explosive 421 is added onto the first explosive 407 by additive manufacturing. The second explosive 421 is deposited on the first explosive 407 by the print head 408. The print head 408 has a nozzle for extruding the stream of the second explosive material 421 onto the on the first explosive 407. The supply of second material 414 provides the stream 420 of material 421. Movement of the print head 408 creates the second explosive 421. The second explosive 421 is formed on surface cone shape 407*a* of the first expulsive 407. There are no voids left by the additive manufacturing system 400.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. A method of producing an energetic device that includes control of output shockwave properties, comprising the steps of:

providing an energetic material unit having at least a first portion of first energetic material and a second portion of second energetic material, using an additive manufacturing system having a print head and a build platform for producing said first portion of first energetic material by moving said print head and extruding said first energetic material onto said build platform, using said additive manufacturing system having a print head and a build platform for producing said second portion of said energetic material by moving said print head and extruding said second energetic material onto said build platform, and by locating said first portion of first energetic material and said second portion of second energetic material relative to each other such that no voids exist therebetween creating said energetic material unit to provide the energetic device that includes control of output shockwave properties.

2. The method of producing an energetic device of claim 1 wherein said energetic material has a cylindrical shape further comprising a second print head in said additive manufacturing system wherein said step of using said additive manufacturing system for producing said second portion of said energetic material by moving said print head and extruding said second energetic material onto said build platform comprises moving said second print head and extruding said second energetic material onto said build platform.

3. The method of producing an energetic device of claim 1 wherein said energetic material unit is an explosive material unit and wherein said first portion has a first detonation velocity and wherein second portion has a second detonation velocity and wherein said first detonation velocity is faster than said second detonation velocity, and wherein said first detonation velocity is related to said second detonation velocity in a manner to control of the output shockwave properties of said explosive.

4. A method of producing a device that includes control of the output shockwave properties of explosive material, comprising the steps of:

providing a first explosive material, providing a second explosive material, using an additive manufacturing system having a print head and a build platform for producing a first unit containing said first explosive material by moving said print head and extruding said second explosive material onto said build platform, using said additive manufacturing system having a print head and a build platform for producing a second unit containing said second explosive material by moving said print head and extruding said second explosive material onto said build platform, and using said additive manufacturing system having a print head and a build platform for positioning said first explosive material and said second explosive material relative to each other such that no voids exist therebetween to provide the device that includes control of the output shockwave properties of explosive material.

5. The method of producing a device that includes control of the output shockwave properties of explosive material of claim 4 wherein said first explosive has a first detonation velocity and wherein second explosive has a second detonation velocity and wherein said first detonation velocity is faster than said second detonation velocity.

6. The method of producing a device that includes control of the output shockwave properties of explosive material of claim 4 wherein said first explosive has a first detonation velocity and wherein second explosive has a second detonation velocity and wherein said first detonation velocity is faster than said second detonation velocity and wherein said first detonation velocity is related to said second detonation velocity in a manner to control the output shockwave properties of explosive material.

7. The method of producing a device that includes control of the output shockwave properties of explosive material of claim 4 further comprising a second print head in said additive manufacturing system wherein said step of using said additive manufacturing system for producing said second explosive material comprises moving said second print head and extruding said second explosive material onto said build platform.

8. The method of producing a device that includes control of the output shockwave properties of explosive material of claim 4 wherein said first explosive has an outer sheath of said first explosive having a first detonation velocity and wherein second explosive includes a central cone of explosive with a second detonation velocity and wherein said first detonation velocity is faster than said second detonation velocity and wherein said first detonation velocity is related to said second detonation velocity in a manner to control the output shockwave properties of explosive material.

9. An apparatus that includes control of the output shockwave properties, comprising:

an energetic material unit having at least a first portion of first energetic material and a second portion of second energetic material, an additive manufacturing system having a print head and a build platform for producing said first portion of first energetic material by moving said print head and extruding said first energetic material onto said build platform, and for producing said second portion of second energetic material by moving said print head and extruding said second energetic material onto said build platform, wherein said first portion of first energetic material and said second portion of second energetic material are positioned relative to each other such that no voids exist therebetween to provide the apparatus that includes control of the output shockwave properties of said energetic material unit.

10. The apparatus that includes control of the output shockwave properties of claim 9 further comprising a second print head in said additive manufacturing system wherein said additive manufacturing system for producing said second portion of second energetic material moves said second print head and extrudes said second energetic material onto said build platform.

11. The apparatus that includes control of the output shockwave properties of claim 9 wherein said energetic material is an explosive and wherein said first portion has a first detonation velocity and wherein second portion has a second detonation velocity and wherein said first detonation velocity is faster than said second detonation velocity, and wherein said first detonation velocity is related to said second detonation velocity in a manner to control of the output shockwave properties of said explosive.

12. An apparatus that includes control of the output shockwave properties of explosive material, comprising:

a first explosive material, a second explosive material, and an additive manufacturing system including a print head and a build platform for combining said first explosive material and said second explosive material using said print head by moving said print head and extruding said first explosive material onto said build platform, and moving said print head and extruding said second explosive material onto said build platform, wherein said first explosive material and said second explosive material are positioned relative to each other such that no voids exist therebetween to provide control of the output shockwave properties of the device.

13. The apparatus that includes control of the output shockwave properties of explosive material of claim 12 wherein said first explosive material has a first detonation velocity and wherein second explosive material has a second detonation velocity and wherein said first detonation velocity is faster than said second detonation velocity.

14. The apparatus that includes control of the output shockwave properties of explosive material of claim 12 wherein said first explosive material has a first detonation velocity and wherein second explosive material has a second detonation velocity and wherein said first detonation velocity is faster than said second detonation velocity and wherein said first detonation velocity is related to said second detonation velocity in a manner to control of the output shockwave properties of explosive material.

15. The apparatus that includes control of the output shockwave properties of explosive material of claim 12 wherein said first explosive material has an outer sheath of said first explosive having a first detonation velocity and wherein second explosive material includes a central cone of explosive with a second detonation velocity and wherein said first detonation velocity is faster than said second detonation velocity.

16. The apparatus that includes control of the output shockwave properties of explosive material of claim 12 further comprising a second print head in said additive manufacturing system wherein said additive manufacturing system for producing said second portion of second explosive material moves said second print head and extrudes said second explosive material onto said build platform.

* * * * *